US010352158B2

(12) United States Patent
Pei et al.

(10) Patent No.: US 10,352,158 B2
(45) Date of Patent: Jul. 16, 2019

(54) SYNTHETIC FORMATION EVALUATION LOGS BASED ON DRILLING VIBRATIONS

(75) Inventors: Jianyong Pei, Katy, TX (US); Thomas G. Dahl, Schwuelper (DE); John D. Macpherson, Spring, TX (US); Pushkar N. Jogi, Bellaire, TX (US); Hanno Reckmann, Nienhagen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 632 days.

(21) Appl. No.: 13/408,705

(22) Filed: Feb. 29, 2012

(65) Prior Publication Data

US 2012/0222901 A1 Sep. 6, 2012

Related U.S. Application Data

(60) Provisional application No. 61/448,736, filed on Mar. 3, 2011.

(51) Int. Cl.

| | |
|---|---|
| ***G01V 1/40*** | (2006.01) |
| ***E21B 49/00*** | (2006.01) |
| *E21B 41/00* | (2006.01) |

(52) U.S. Cl.

CPC .... *E21B 49/003* (2013.01); *E21B 2041/0028* (2013.01)

(58) Field of Classification Search

CPC ..... E21B 2041/0028; E21B 49/003; E21B 10/003; E21B 10/26; E21B 10/55; E21B 10/60; E21B 10/602; E21B 17/003; E21B 17/1092; E21B 44/00; E21B 47/102; E21B 47/10; E21B 7/04; E21B 49/006; E21B 7/00; G01J 4/00; G01J 9/00; G01L 1/241; G01N 24/081; G01N 3/52; G01P 15/093;

(Continued)

(56) References Cited

U.S. PATENT DOCUMENTS 2,396,935 A * 3/1946 Walstrom ..... E21B 47/101 181/102
3,815,691 A * 6/1974 Richter, Jr. ..... E21B 17/20 175/320

(Continued)

OTHER PUBLICATIONS

Raynal, J. et al.; "Instantaneous Logging While Drilling the Aqui-Log (or SNAP log) and Some Possible Applications," SPE 4489, 1973, Figs. 1-14, pp. 1-12.

(Continued)

*Primary Examiner* — Toan M Le
*Assistant Examiner* — Xiuqin Sun
(74) *Attorney, Agent, or Firm* — Cantor Colburn LLP

(57) ABSTRACT

A method and apparatus for predicting a formation parameter at a drill bit drilling a formation is disclosed. A vibration measurement is obtained at each of a plurality of depths in the borehole. A formation parameter is obtained proximate each of the plurality of depths in the borehole. A relationship is determined between the obtained vibration measurements and the measured formation parameters at the plurality of depths. A vibration measurement at a new drill bit location is obtained and the formation parameter at the new drill bit location is predicted from the vibration measurement and the determined relation. Formation type can be determined at the new drill bit location from the new vibration measurement and the determined relationship.

18 Claims, 11 Drawing Sheets

(58) Field of Classification Search
CPC ..... G01V 11/00; G01V 11/002; G01V 1/44; G01V 3/26; G01V 3/28; G01V 3/32; G01V 1/047; G01V 1/157; G01V 1/32; G01V 1/48; G01V 1/52; G01V 2001/526
USPC ..... 702/11
See application file for complete search history.

(56) References Cited

U.S. PATENT DOCUMENTS

| | | | | |
|---|---|---|---|---|
| 4,703,463 | A * | 10/1987 | Izard | 367/147 |
| 5,138,875 | A * | 8/1992 | Booer | 73/152.47 |
| 6,206,108 | B1 * | 3/2001 | MacDonald et al. | 175/24 |
| 6,885,942 | B2 * | 4/2005 | Shray et al. | 702/6 |
| 7,142,986 | B2 | 11/2006 | Moran | |
| 2004/0256101 | A1 | 12/2004 | Fox et al. | |
| 2006/0096380 | A1 * | 5/2006 | Novascone et al. | 73/649 |
| 2006/0212224 | A1 * | 9/2006 | Jogi et al. | 702/9 |
| 2008/0066965 | A1 | 3/2008 | Pabon et al. | |
| 2008/0262810 | A1 * | 10/2008 | Moran et al. | 703/10 |
| 2010/0118657 | A1 * | 5/2010 | Trinh et al. | 367/82 |
| 2010/0284247 | A1 * | 11/2010 | Manning et al. | 367/28 |
| 2011/0048802 | A1 * | 3/2011 | Fincher et al. | 175/48 |
| 2011/0253448 | A1 * | 10/2011 | Trinh et al. | 175/50 |
| 2012/0255788 | A1 * | 10/2012 | Schwefe et al. | 175/61 |
| 2013/0234012 | A1 * | 9/2013 | Morris et al. | 250/269.6 |

OTHER PUBLICATIONS

Reckmann, H. et al.; "Using Dynamics Measurements While Drilling to Detect Lithology Changes and to Model Drilling Dynamics," Proceedings of the 26th International Conference on Offshore Mechanics and Arctic Engineering, OMAE2007, San Diego, California, Jun. 10-15, 2007, pp. 1-10.

International Search Report and Written Opinion dated Nov. 30, 2012 for International Application No. PCT/US2012/027518.

* cited by examiner

SYNTHETIC FORMATION EVALUATION LOGS BASED ON DRILLING VIBRATIONS

CROSS-REFERENCE TO RELATED APPLICATIONS

This application claims priority to U.S. Provisional Application Ser. No. 61/448,736, filed Mar. 3, 2011.

BACKGROUND OF THE DISCLOSURE

1. Field of the Disclosure

The present disclosure is related to methods for determining a formation parameter at a drill bit location as well as for determining a formation type at a drill bit location in real-time while drilling.

2. Description of the Related Art

Drilling for oil typically includes using a drill string extending into the earth and having a drill bit at one end to drill a borehole. When drilling the borehole, it is generally understood that the drill bit will pass through several formation layers. The type of formation generally affects operation of the drill bit. Therefore, knowing the type of formation can be very useful. Various drilling systems, including measurement-while-drilling (MWD) and logging-while-drilling (LWD) include formation evaluation sensors which can be used to determine formation type. Unfortunately, these formation evaluation sensors are typically at a location on the drill string uphole of the drill bit, often at a distance greater than 100 ft., and subsequently obtain relevant formation measurements only after the formation has been drilled. Therefore, such formation measurements are generally not usable in determining the formation at the drill bit. The present disclosure provides methods and apparatus for determining formation type at the drill bit and/or a formation parameter at the drill bit using formation measurements obtained at the formation sensors.

SUMMARY OF THE DISCLOSURE

In one aspect, the present disclosure provides a method of predicting a formation parameter at a drill bit drilling a formation, including: obtaining a vibration measurement at each of a plurality of depths in the borehole; measuring a formation parameter at proximate each of the plurality of depths in the borehole; determining a relationship between the obtained vibration measurements and the measured formation parameters at the plurality of depths; obtaining a vibration measurement at a new drill bit location; and predicting the formation parameter at the new drill bit location from the vibration measurement and the determined relationship.

Also provided herein is a method of determining a formation type at a drill bit that includes: obtaining drill bit vibration measurements and formation parameter measurements at a plurality of depths in a borehole; selecting a subset of the vibration measurements based on formation parameter measurements; determining a trend of the selected vibration measurements with depth; obtaining a vibration measurement at a new drill bit location; and predicting the formation type at the new drill bit location from the new vibration measurement and the determined trend.

Also provided herein is a computer-readable medium having instruction stored therein that when accessed by a processor enable the processor to perform a method, the method comprising: receiving vibration measurements obtained at a plurality of depths in the borehole; receiving formation parameter measurements obtained at the plurality of depths in the borehole; determining a relation between the vibration measurements and the formation parameters at the plurality of depths; receiving a vibration measurement obtained at a drill bit location; and predicting the formation parameter at the drill bit location using the vibration measurement and the determined relation.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
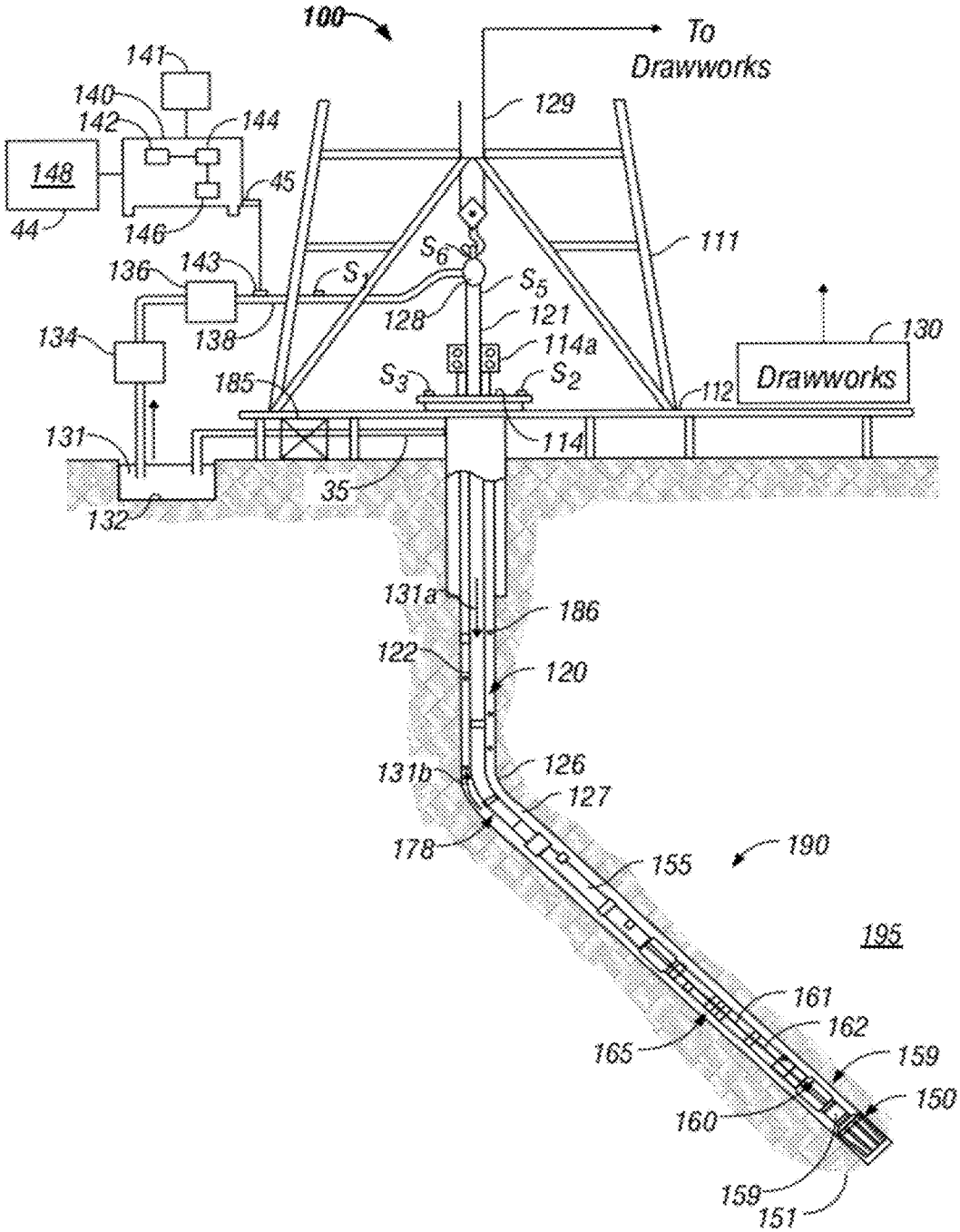
FIG. 1 is a schematic diagram of an exemplary drilling system that includes a drill string having a drilling assembly attached to its bottom end that includes various sensors for obtaining measurements usable according to the various methods of the disclosure.

FIG. 1 is a schematic diagram of an exemplary drilling system 100 that includes a drill string having a drilling assembly attached to its bottom end that includes various sensors and apparatuses for obtaining measurements usable according to the various methods of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122 having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 can be rotated by a top drive (not shown) instead of by the prime mover and the rotary table 114. The operation of the drawworks 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a de-surger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 can be determined from the sensor $S_5$, while the sensor $S_6$ can provide the hook load of the drill string 120.

In some applications, the drill bit 150 is rotated by rotating the drill pipe 122. However, in other applications, a downhole motor 155 (mud motor) disposed in the drilling assembly 190 also rotates the drill bit 150. The rate of penetration ("ROP") for a given drill bit and BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 141 that is utilized by an operator to control the drilling operations. The surface control unit 140 can be a computer-based unit that can include a processor 142 (such as a microprocessor), a storage device 144, such as a solid-state memory, tape or hard disc, and one or more computer programs 146 in the storage device 144 that are accessible to the processor 142 for executing instructions contained in such programs to perform the methods disclosed herein. The surface control unit 140 can further communicate with a remote control unit 148. The surface control unit 140 can process data relating to the drilling operations, data from the sensors and devices on the surface, data received from downhole and can control one or more operations of the downhole and surface devices. In addition, the methods disclosed herein can be performed at a downhole processor 162.

The drilling assembly 190 also contains formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. Formation evaluation sensors can measure natural gamma ray levels (GR), neutron porosity measurements (NP), and bulk density measurements (BD) in various embodiments of the disclosure. The drilling assembly 190 can further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. In various embodiments, exemplary sensors 159 obtain vibration measurements for determining a formation parameter at a drill bit or determining a formation type at the drill bit using the methods described herein. Although the vibration sensor is shown as sensor 159 at the drilling assembly 190, exemplary sensors for obtaining vibration measurements related to the drill bit can be located at any suitable position along the drill string 120.

Still referring to FIG. 1, the drill string 120 further includes energy conversion devices 160 and 178. In an aspect, the energy conversion device 160 is located in the BHA 190 to provide an electrical power or energy, such as current, to sensors 165 and/or communication devices 159. Energy conversion device 178 is located in the drill string 120 tubular, wherein the device provides current to distributed sensors located on the tubular. As depicted, the energy conversion devices 160 and 178 convert or harvest energy from pressure waves of drilling mud which are received by and flow through the drill string 120 and BHA 190. Thus, the energy conversion devices 160 and 178 utilize an active material to directly convert the received pressure waves into electrical energy. As depicted, the pressure pulses are generated at the surface by a modulator, such as a telemetry communication modulator, and/or as a result of drilling activity and maintenance. Accordingly, the energy conversion devices 160 and 178 provide a direct and continuous source of electrical energy to a plurality of locations downhole without power storage (battery) or an electrical connection to the surface.

In various aspects of drilling, it is useful to obtain measurements related to the formation at the drill bit. Formation evaluation sensors, which typical obtain such measurements, are typical uphole and away from the drill bit. In one aspect, the present disclosure provides a method and apparatus for determining a rock formation type from a vibration measurement or suitable operation parameter obtained at a drill bit and formation measurements obtained at formation evaluation sensors. In another aspect, the present disclosure provides a method and apparatus for determining a log of a formation parameter at the drill bit using the measured vibration or suitable operational parameter of the drill bit upon drilling the borehole and formation measurements obtained at formation evaluation sensors.

Figure 2:
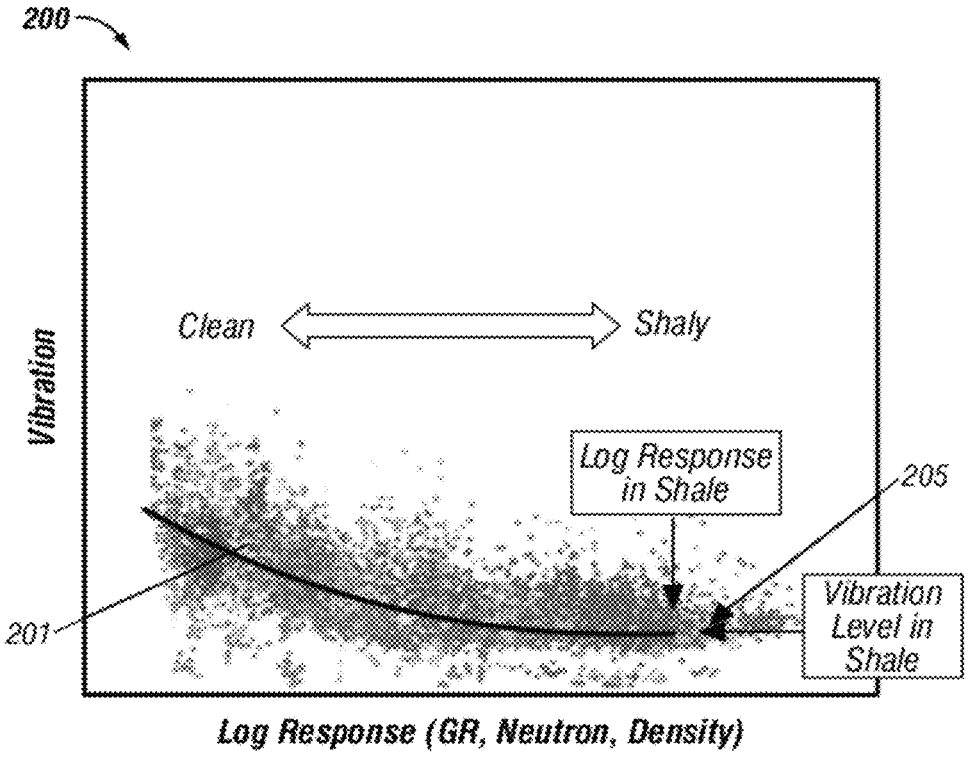
FIG. 2 shows an exemplary graph of vibration measurements against formation parameter measurements.

FIG. 2 shows an exemplary graph 200 of vibration measurements against formation parameter measurements. Each data point of graph 200 is determined from a formation measurement and a vibration measurement obtained at a proximate location in a borehole. In various exemplary embodiments, the vibration measurement can be an axial, tangential or lateral vibration measurement. Correlation curve 201 is drawn through the data points using a suitable curve-fitting method. In various embodiments, the formation measurements can be measurements of gamma ray radiation (GR), neutron porosity (NP), and bulk density (BD), among others. The exemplary formation parameters are typically suitable for determining formation type. For example, a gamma ray measurement is generally indicative of whether a rock formation is a shale or a non-shale. Shales typically produce high levels of gamma ray radiation, whereas non-shales (i.e., sandstones) typically produce low levels of gamma ray radiation. Therefore, data points from shale formations (high gamma ray radiation) are generally on the right-hand side of graph 200 and data points from non-shale sandstone (low gamma ray radiation) are generally on the left-hand side. It is also observed that shales and non-shales have different effects on the vibration level of the drill bit during drilling. Shales typically produce low levels of vibration when drilled, whereas non-shale sandstones typically produce high levels of vibration when drilled. Thus, the correlation curve 201 generally decreases from left to right. In one aspect of the present disclosure, the correlation curve 201 can be used to determine a log of formation parameters at the drill bit location, as discussed below.

Figure 3A:
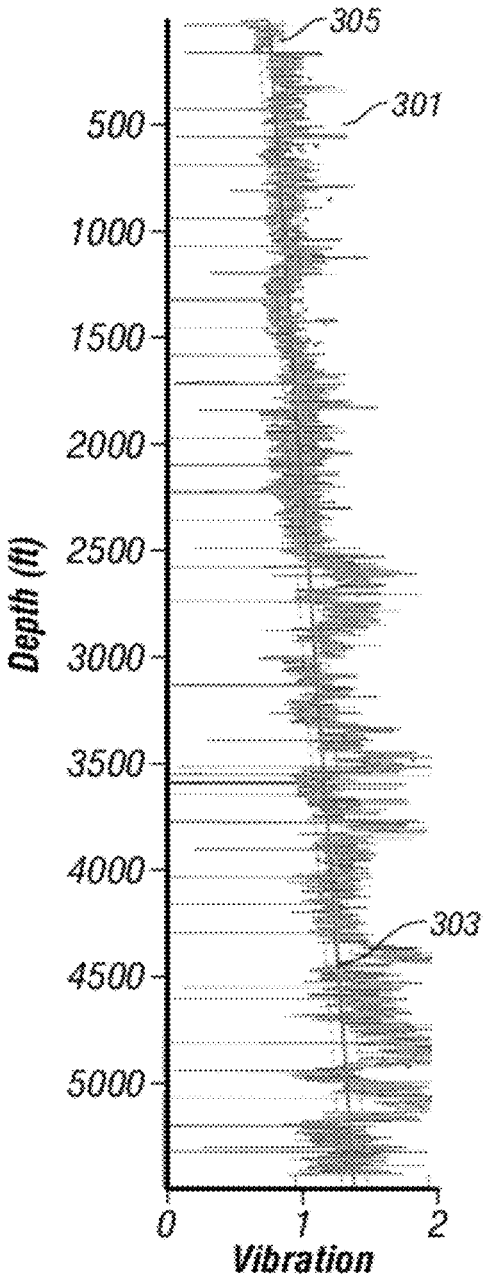
FIG. 3A shows a log of drill bit vibration vs. depth and a related vibration shale baseline.
Figure 3B:
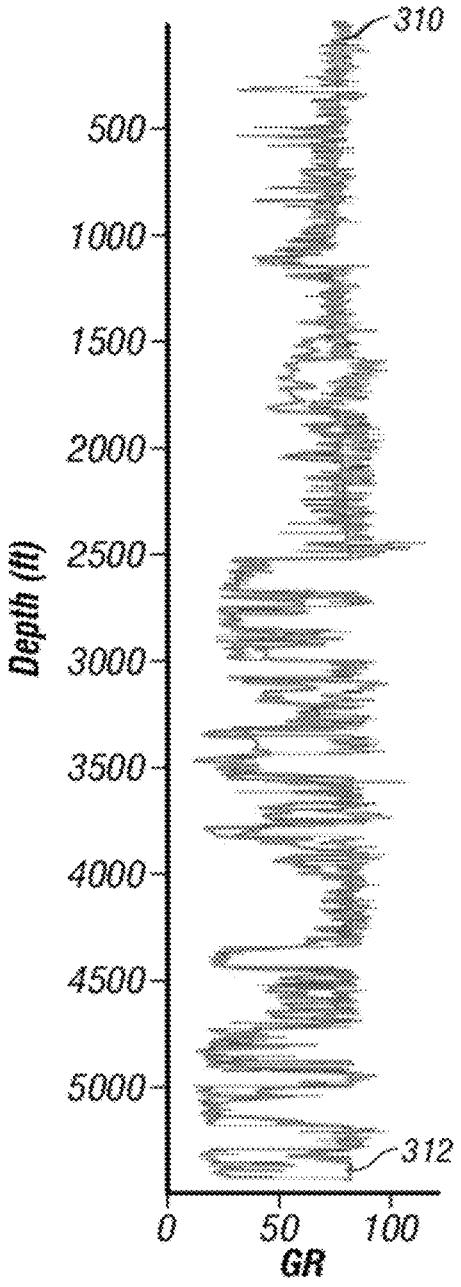
FIGS. 3B-3D shows exemplary logs of formation parameters obtained from the exemplary formation sensors and exemplary synthetic logs of the formation parameter at the drill bit obtained using vibration measurements at a drill bit and the methods disclosed herein.
Figure 3C:
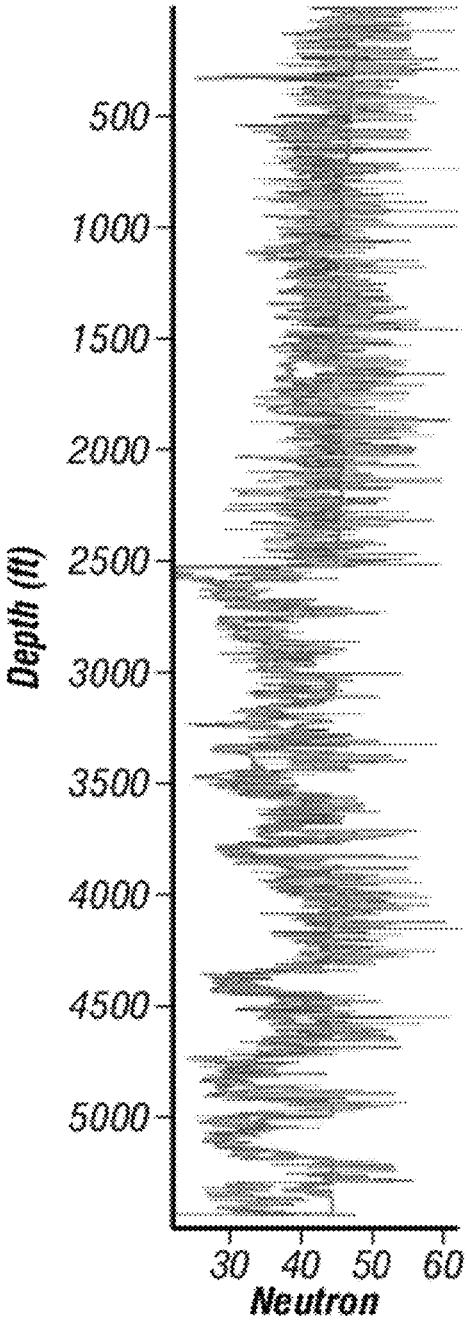
Figure 3D:
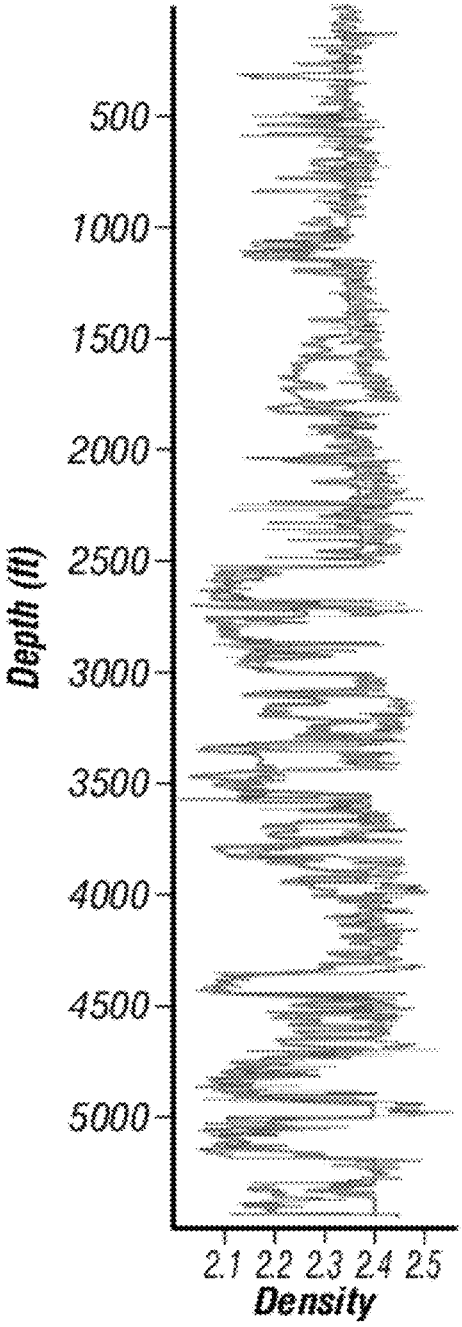
Figure 3E:
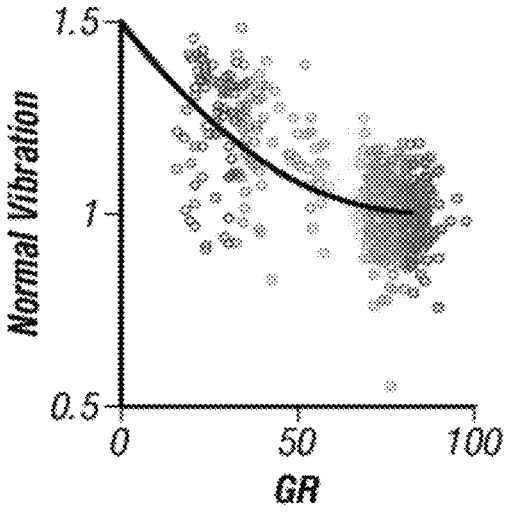
FIGS. 3E-3G show various correlation graphs related to FIGS. 3B-3D, respectively.
Figure 3F:
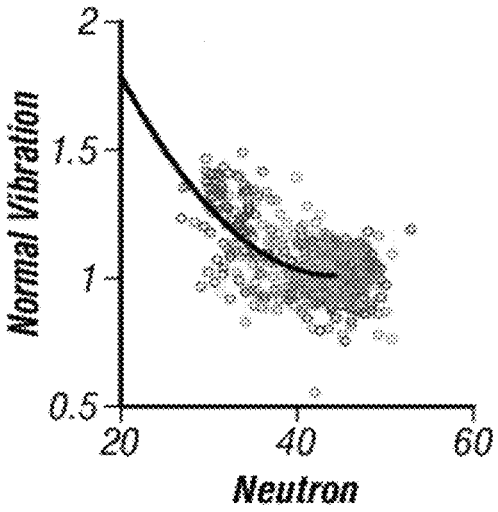
Figure 3G:
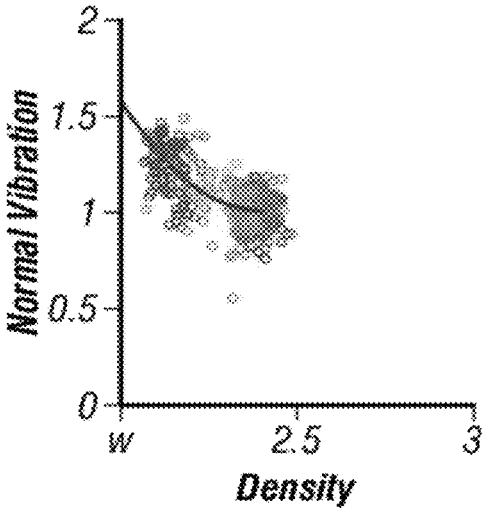

FIG. 3A shows a log of vibration measurements obtained at a drill bit a plurality of depths within a borehole as well as a vibration shale baseline. FIGS. 3B-3D show various logs of formation parameters obtained in a borehole. FIGS. 3E-3G show various graphs of vibration measurements against the respective formation parameters of FIGS. 3B-3D similar to graph 200 of FIG. 2.

FIG. 3A shows a log 301 of drill bit vibration vs. depth and a related vibration shale baseline 303. Log 301 can include suitable operational measurements obtained at drill bit sensor 158 which can be an axial vibration, lateral vibration, torsional vibration, stick-slip, weight-on-bit, torque-on-bit, etc. or any quantity derived from these measurements. Line 303 is referred to herein as a vibration shale baseline (VSB). The VSB 303 indicates a trend of vibration measurements at the drill bit with depth for shale formations. As shown in FIG. 3A, drill bit vibration typically increases with depth in shale formations. In one aspect, a logarithm of the vibration can vary linearly with depth.

VSB 303 can be determined using a linear regression of the vibration measurements 301 in shale formations. Other suitable methods of fitting vibration measurements in shale formation can also be used. The VSB can be determined using some or all available vibration measurements between a surface location and the location of the formation evaluation sensor. Alternately, the VSB can be determined using vibration measurements selected from a set of most recently obtained vibration measurements. Other methods for determining VSB can be useful if there is a change of shale baseline. In one embodiment, vibration measurements obtained from shale formations in the exemplary intervals stated above are selected to determine the VSB, and non-shale vibration measurements are not used to determine the VSB. In an exemplary embodiment, suitable formation parameter measurements such as gamma ray measurements can be used to determine whether the vibration measurement is related to a shale or a non-shale and thus whether or not the vibration measurement is selected for use in determining the VSB.

The VSB is obtained using selected vibration measurements above a depth of the formation sensor, since a particular vibration measurement is selected once the formation sensor reaches the particular depth and obtains a related formation parameter measurement that can be related to the vibration measurement at the particular depth. Typically, vibration measurements are obtained at the drill bit and are stored in a memory location, such as memory location 144 or downhole memory location 161 of FIG. 1, until the formation sensor arrives at or proximate the vibration measurement location. Vibration measurements and their related formation parameter measurements are considered to be from the same formation layer. Therefore, these measurements can be correlated to formation type. Formation parameter measurements obtained proximate the location at which the stored vibration measurements are obtained are used to select the vibration measurement for the VSB and to provide a data point to the exemplary graph 200. Exemplary gamma ray measurements can be seen in log 310 of FIG. 3B.

Returning to FIG. 3A, the obtained VSB predicts a vibration value for a shale formation at a new drill bit location. Obtained vibration measurements at the new drill bit location can be compared to the predicted value to determine formation type at the drill bit using a selected criterion. In an exemplary embodiment, the criterion is a standard deviation of the VSB, such as plus one standard deviation (305), although any suitable criterion can be used. For example, if a difference between the value of the measured vibration at the new drill bit location and the value predicted by the VSB is less than the criterion, the formation is determined to be shale. If the difference is greater than the criterion, the formation is determined to be a non-shale formation.

In another aspect of the present disclosure, a log of a formation parameter can be determined at the drill bit using vibration measurements obtained at the drill bit location and the exemplary correlation curve 201 of FIG. 2. If comparison of the vibration measurement to the VSB determines the formation to be shale, as discussed above, a representative value of the formation parameter at the drill bit can be selected from graph 200. Shales tend to have high gamma-ray radiation levels. Thus, when the gamma-ray radiation level of the shale is higher than the highest value of the correlation curve 201, this representative value 205 is a single value selected from the right hand side the correlation curve 201. If comparison of the vibration measurement to the VSB determines the formation to be non-shale, then a value of the formation parameter can be selected using a value selected along the exemplary correlation curve 201.

FIG. 3B shows an exemplary log 310 obtained from the exemplary formation sensors and an exemplary log 312, referred to herein as a synthetic log, obtained using vibration measurements obtained at the drill bit and the methods disclosed herein, wherein the formation parameter is gamma ray radiation. FIG. 3E shows an exemplary graph (similar to FIG. 2) of normalized vibration measurements and gamma ray radiation levels corresponding to the exemplary log 310. Normalized vibration is obtained by normalizing the measured vibration level against the shale vibration level as calculated from the VSB. The exemplary log 312 is determined using values selected from the exemplary graph of FIG. 3E. Since only a single value is selected for the synthetic log from the FIG. 3B if the formation is a shale, the right-hand side of synthetic log 312 can have a sharp edge. Also, since the correlation curve generally changes as additional data points are added to the correlation graph, the right-hand side of synthetic log 312 can change with depth. This applies equally to the synthetic logs of FIGS. 3C and 3D.

The synthetic log 312 generally agrees with the gamma ray log 310 at equivalent depths. Any differences between synthetic log and formation log at a particular depth can be used to determine additional information about the formation. For example, the differences can be related to drilling dysfunctions, the presence of formation types besides shale and sandstone, etc. Differences between the synthetic log and the formation log can also be used to improve the method of obtaining the synthetic log 312.

FIGS. 3C and 3D show formation parameter logs and synthetic logs obtained with respect to neutron porosity measurements and bulk density measurements, respectively, using the methods disclosed herein. FIGS. 3F and 3G show various graphs of vibration measurements vs. the related formation parameters of FIGS. 3C and 3D, respectively.

Figures 4A, 4B:
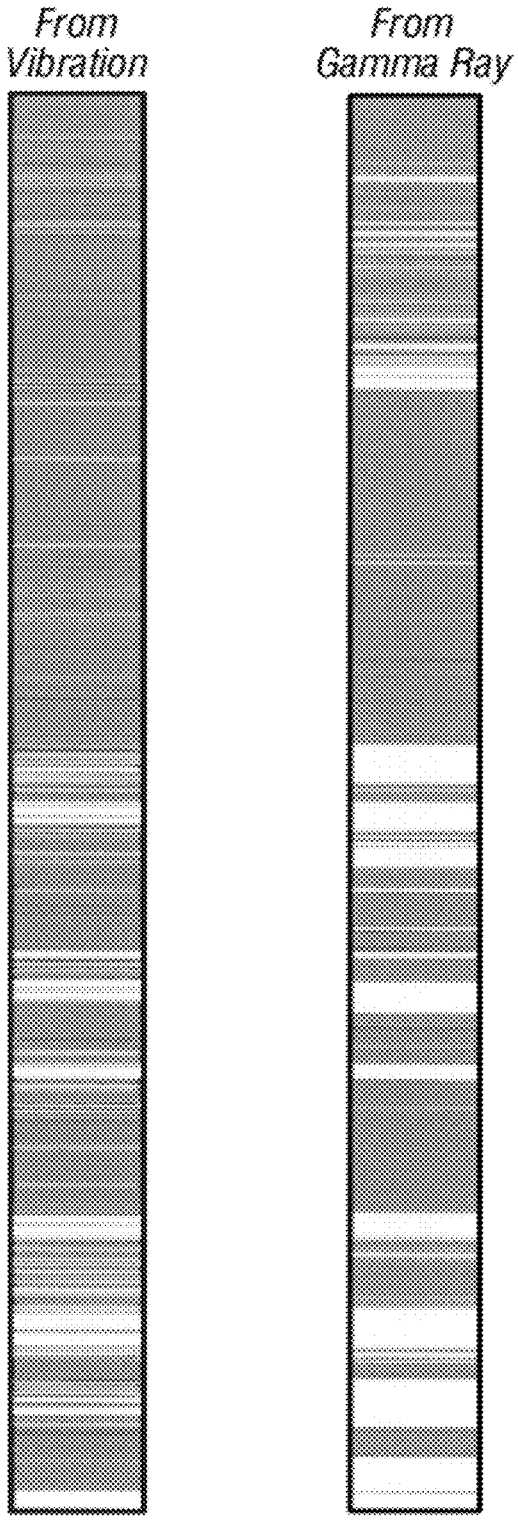
FIGS. 4A-4B shows various logs of formation types obtained using the various methods disclosed herein.

FIGS. 4A-4B shows various logs determined using the methods disclosed herein. FIG. 4A shows a log indicating shale and non-shale formation layers determined by comparing vibration measurements obtained at a drill bit with predicted values of the VSB. FIG. 4B shows a log indicating formation layers obtained from gamma ray measurements obtained using exemplary formation evaluation sensors.

Figure 5A:
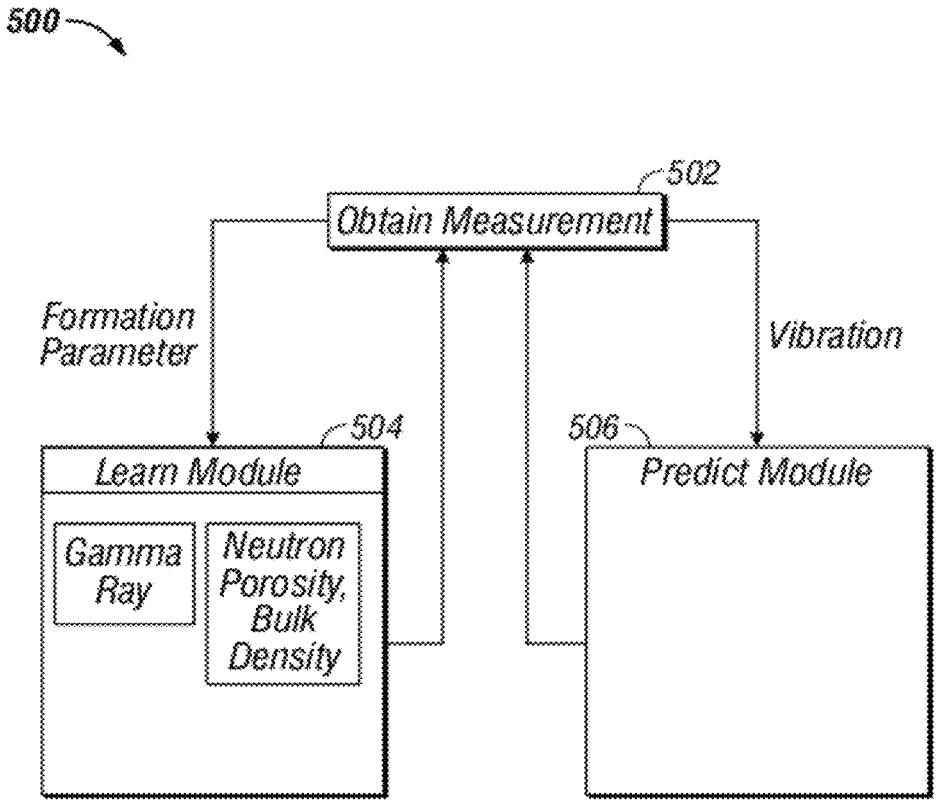
FIG. 5A shows an exemplary flowchart of the present disclosure for performing the various methods of the present disclosure using a Learn Module and a Predict Module.

FIG. 5A shows an exemplary flowchart 500 of the present disclosure for performing the various methods disclosed herein. The flowchart 500 shows a 'Learn and Predict' module for determining the rock formation property at the drill bit and for determining a synthetic log of a formation parameter at the drill bit. The Learn module determines the correlation discussed herein and the Predict module predicts formation type and formation parameters at the drill bit. A measurement is obtained in Box 502. The measurement can be obtained at a set depth interval or at a set time interval. The measurements obtained in Box 502 can be vibration measurements obtained at the drill bit and/or formation parameter measurements obtained at exemplary formation evaluation sensors uphole of the drill bit. Both vibration measurements and formation evaluation measurements can be obtained at the same time. If the obtained measurement is a formation parameter, a Learn Module 504 is entered. If the obtained measurement is a suitable operational parameter, such as a vibration measurement, a Predict Module 506 is entered. The Learn Module performs various processes depending on the particular formation parameter obtained. For example, the Learn Module includes a module for gamma ray measurements 508 and a module for neutron porosity and/or bulk density measurements 510. The details of the Learn Module are discussed with respect to FIGS. 5B and 5C. The Predict Module is entered when the received measurement is a vibration measurement and is used to produce a synthetic log of a selected formation parameter based on the obtained drill bit vibration measurement and the relevant correlations of FIGS. 3E-3G, for example. The details of the Predict Module are discussed with respect to FIG. 5D. Upon exiting either the Learn Module or the Predict Module, another measurement can be obtained at Box 502 and the Learn/Predict Module can be entered using the new measurement. In this manner, exemplary graphs of FIGS. 3E-3G are continually updated and a value for a relation synthetic formation log at the drill bit obtained at each new depth.

Figure 5B:
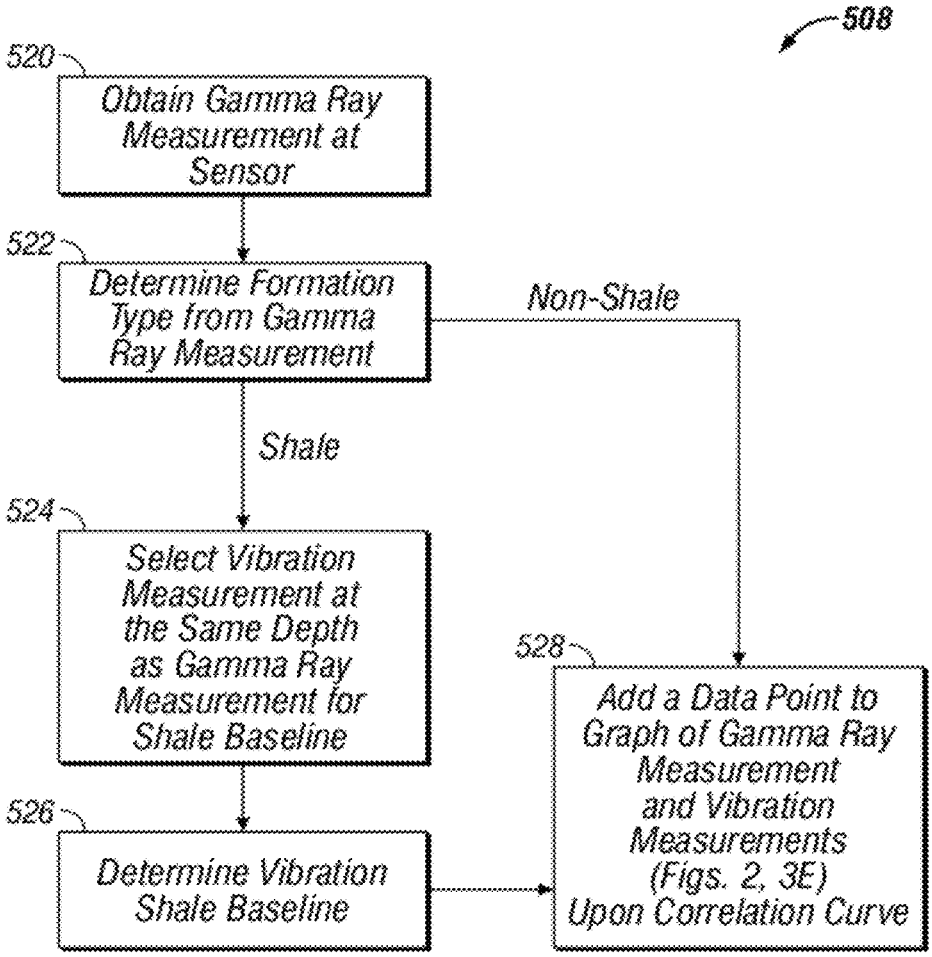
FIG. 5B shows a detailed flowchart of a Learn Module using obtained formation parameter measurements of gamma rays.

FIG. 5B shows a detailed flowchart of the Learn Module for obtained formation parameter measurements that are gamma ray measurements (508 of FIG. 5A). In Box 520, a gamma ray measurement is received from a formation evaluation sensor at a particular depth. In Box 522, the gamma ray measurement is used to determine the formation type at the depth of the formation evaluation sensor, i.e., whether the formation at the sensor is a shale or a non-shale. If the gamma ray measurement indicates the formation is a shale, a vibration measurement obtained at the particular depth is selected for use in determining the vibration shale baseline 303 (Box 524). The vibration shale baseline may then be updated in Box 526. The vibration shale baseline is determined using, for example, a linear regression of selected vibration measurements at various depths. Whether or not the formation type is determined to be a shale, a data point is added to the exemplary graph of FIG. 3E (Box 528), wherein the data point relates the obtained gamma ray measurement and a vibration measurement obtained at a proximate depth to the gamma ray measurement. The correlation curve of FIG. 3E can then be recalculated incorporating the new data point.

Figure 5C:
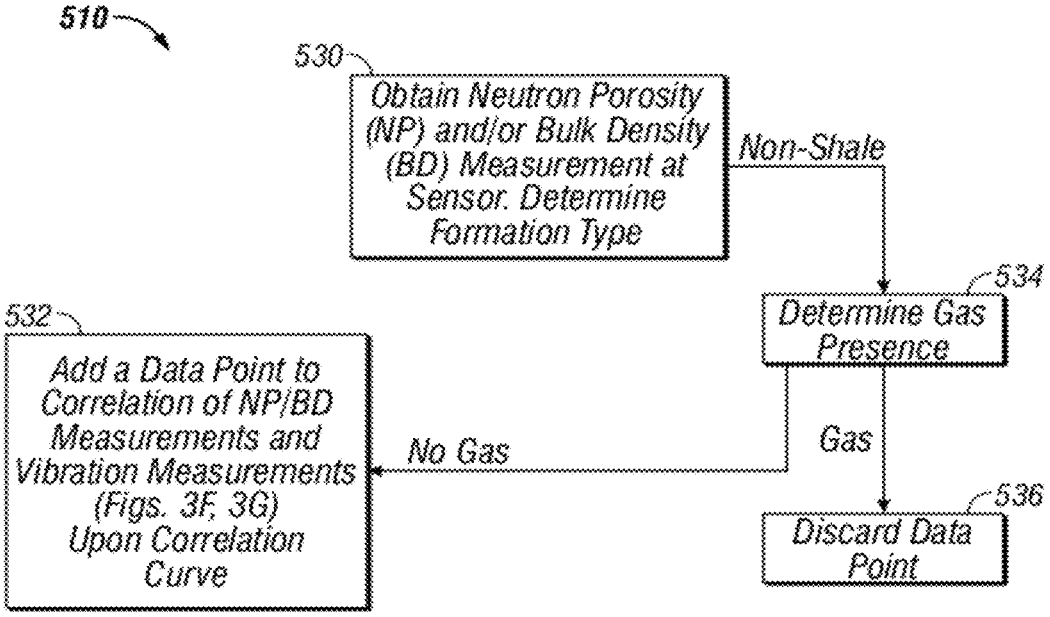
FIG. 5C shows a detailed flowchart of the Learn Module for the obtained formation parameter measurements of neutron porosity and/or bulk density.

FIG. 5C shows a detailed flowchart of the Learn Module for when the obtained formation parameter measurement is neutron porosity and/or bulk density measurements (510 of FIG. 5A). In Box 530, neutron porosity measurements and/or bulk density measurements are obtained from the formation evaluation sensors. A determination of the level of presence of gas is first made (Box 534). If gas is present, then the data point can be discarded (Box 536). However, if no gas is present, then a data point is added to the graphs FIGS. 3F, 3G (Box 532).

Figure 5D:
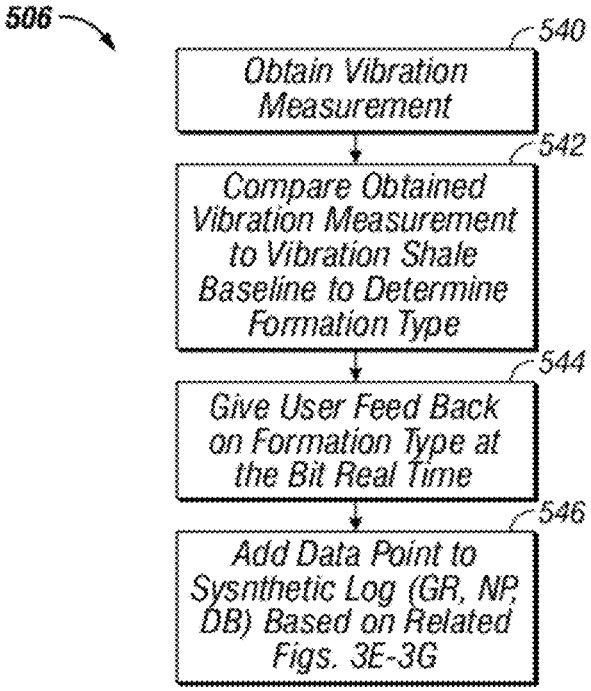
FIG. 5D shows a detailed flowchart for a Predict Module for creating a synthetic log of a formation parameter from drill bit vibrations.

FIG. 5D shows a detailed flowchart for the Predict Module 506 of FIG. 5A for creating a synthetic log of a formation parameter at the drill bit. A new vibration measurement is obtained at Box 540 at a new drill bit location. The obtained new vibration measurement is compared to a prediction of vibration measurement obtained using the vibration shale baseline in order to determine formation type at the drill bit in Box 542. The formation type at the drill bit can be determined from the difference between the new vibration measurement and the predicted value of the vibration measurement at the drill bit location obtained using the methods discussed above. The determined formation type at the drill bit location is provided to the user in real-time (Box 544), so that decisions can be made while drilling based on formation type. In Box 546, a data point for the synthetic log at the drill bit depth is selected based on the relevant graph (i.e., FIG. 3E-3G) as discussed above.

Figure 6:
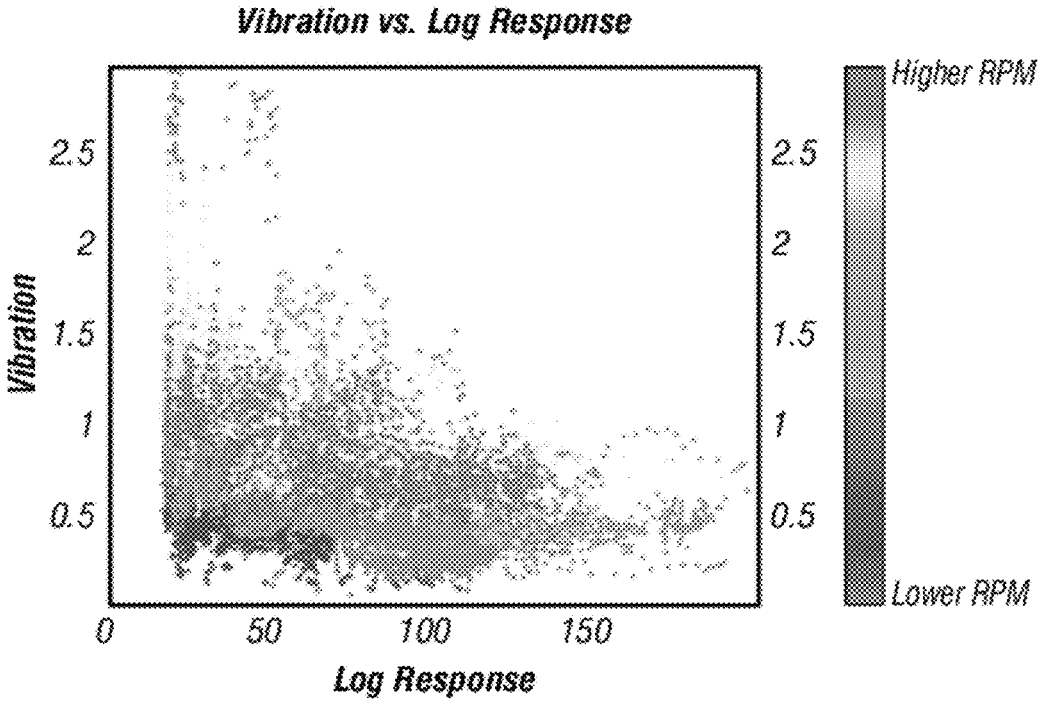
FIG. 6 shows an exemplary graph of vibration measurements vs. gamma ray measurements for various revolutions per minute (RPM) of a drill bit.

FIG. 6 shows an exemplary graph 600 of vibration measurements vs. gamma ray measurements showing data points obtained at various revolutions per minute (RPM) of the drill bit. Vibration measurements at the drill bit are related to drill bit RPM as well as to drilling depth. Therefore, the exemplary graph 600 can be used to remove or reduce the effect of different drill bit RPM on the exemplary graphs of FIGS. 2 and 3E-3G, thereby enabling the obtaining of a more reliable VSB and synthetic log. Graphs similar to graph 600 related to neutron porosity and bulk density measurements can also be obtained.

Figure 7:
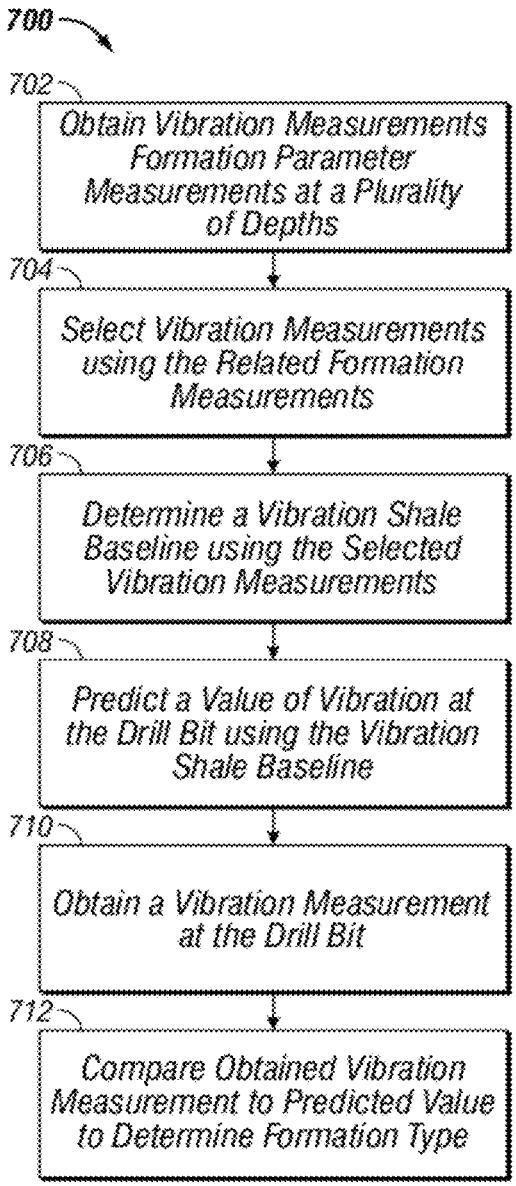
FIG. 7 shows a flowchart for determine a formation type at a drill bit using the exemplary methods of the present disclosure.

FIG. 7 shows a flowchart 700 for determining a formation type at a drill bit using the exemplary methods of the present disclosure. In Box 702, vibration measurements and formation parameter measurements are obtained at a plurality of depths. In Box 704, vibration measurements are selected using related formation measurements obtained at a proximate depth of the vibration measurements. In Box 706, a vibration shale baseline is determined using the selected vibration measurements. In Box 708, a value of vibration at the drill bit is predicted using the determined vibration shale baseline. In Box 710, a new vibration measurement is obtained at a new drill bit location. In Box 712, the obtained new vibration measurement is compared to the vibration value predicted using the vibration shale baseline to determine formation type.

Figure 8:
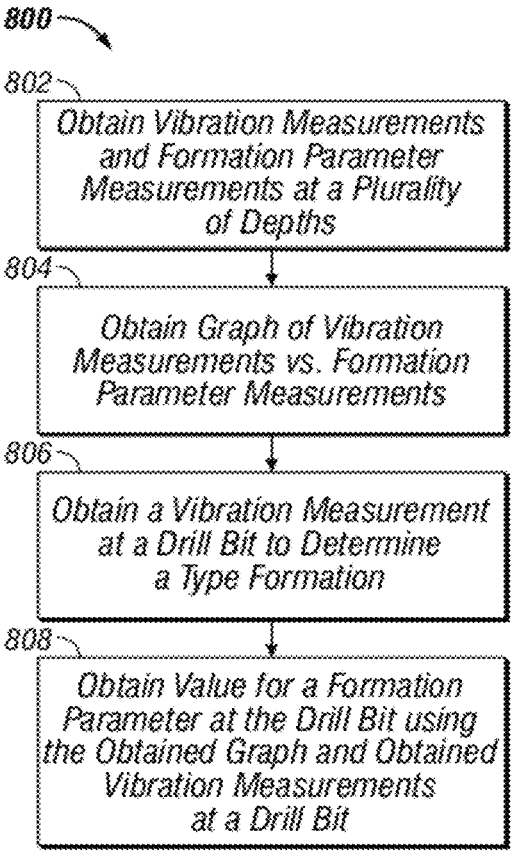
FIG. 8 shows a flowchart for obtaining a synthetic log at a drill bit location.

FIG. 8 shows a flowchart 800 for obtaining a synthetic log at a drill bit location. In Box 802, vibration measurements and formation parameter measurements are obtained at a plurality of depths. In Box, 804 a graph or relation of vibration measurements vs. formation parameter measurements is obtained from the measurements obtained in Box 802. In Box 806, a new vibration measurement is obtained at a new drill bit location to determine a formation type. In Box 808, a value for a formation parameter at the drill bit is obtained using the obtained graph of Box 804 and the obtained new vibration measurement at the drill bit.

The processing of the data may be accomplished by a downhole processor. Alternatively, measurements may be stored on a suitable memory device and processed upon retrieval of the memory device for detailed analysis. Implicit in the control and processing of the data is the use of a computer program on a suitable machine readable medium that enables the processor to perform the methods disclosed herein. The machine readable medium may include ROMs, EPROMs, EAROMs, Flash Memories and Optical disks. All of these media have the capability of storing the data acquired by the logging tool and of storing the instructions for processing the data. It would be apparent to those versed in the art that due to the amount of data being acquired and processed, it is useful to do the processing and analysis with the use of an electronic processor or computer.

Therefore, in one aspect, the present disclosure provides a method of predicting a formation parameter at a drill bit, including: obtaining a vibration measurement at each of a plurality of depths in the borehole; measuring a formation parameter proximate each of the plurality of depths in the borehole; determining a relationship between the obtained vibration measurements and the measured formation parameters at the plurality of depths; obtaining a vibration measurement at a new drill bit location; and predicting the formation parameter at the new drill bit location from the new vibration measurement and the determined relation. Predicting the formation parameter at the drill bit includes selecting a formation parameter value from the relation based on the vibration measurement obtained at the drill bit location. In an exemplary embodiment, predicting the formation parameter at the drill bit includes selecting a single value of the formation parameter for a determined shale formation and selecting a value of the formation parameter from the determined relation for a determined non-shale formation. The formation type can be determined from a comparison of a vibration measurement obtained at the new drill bit location and a predicted value obtained using a vibration shale baseline. The vibration shale baseline is determined using selected vibration measurements, wherein formation parameter measurements are used to select the vibration measurements for determining the vibration shale baseline. In another embodiment, the determined relation is adjusted for a revolution rate of the drill bit. The determined relation can be updated while drilling. The formation parameter can be one of: (i) a gamma ray measurement; (ii) a neutron porosity measurement; (iii) a bulk density measurement; and (iv) a formation parameter measurement having a correlation to a vibration measurement. In various embodiments, the vibration measurements can be an axial vibration, a lateral vibration, or a torsional vibration.

In another aspect, the present disclosure provides a method of determining a formation type at a drill bit drilling a formation, the method including: obtaining drill bit vibration measurements and formation parameter measurements at a plurality of depths in a borehole; selecting a subset of the vibration measurements based on formation parameter measurements; determining a trend of the selected vibration measurements with depth to form a vibration shale baseline; obtaining a vibration measurement at a drill bit location; and predicting the formation type at the drill bit location by comparing the vibration measurement and the determined vibration shale baseline. The subset of vibration measurements can be selected from vibration measurements from a shale formation. The formation type at the drill bit can be determined from a comparison of a vibration measurement obtained at a drill bit location and a predicted value obtained using a vibration shale baseline. The vibration shale baseline can be determined from vibration measurements selected using a related formation parameter measurement. The determined trend can be adjusted to account for a revolution rate of the drill bit. In one embodiment, the trend can be determined while drilling. In various embodiments, the formation parameter is a gamma ray measurement; a neutron porosity measurement; a bulk density measurement; and a formation parameter having a correlation to a vibration measurement. The vibration is typically one of an axial vibration, a lateral vibration, and a torsional vibration.

In yet another aspect, the present provides a computer-readable medium having instruction stored therein that when accessed by a processor enable the processor to perform a method, the method comprising: receiving vibration measurements obtained at a plurality of depths in the borehole; receiving formation parameter measurements obtained at the plurality of depths in the borehole; determining a relation between the vibration measurements and the formation parameters at the plurality of depths; receiving a vibration measurement obtained at a drill bit location; and predicting the formation parameter at the drill bit location using the vibration measurement and the determined relation.

What is claimed is:

1. A method of drilling a formation, comprising:

using a vibration sensor at the drill bit to obtain measurements of drill bit vibration at a plurality of depths in the borehole;

using a formation sensor to obtain formation parameter measurements at the plurality of depths in the borehole;

using a processor to:

form a relation between the measurements of the drill bit vibration and corresponding formation parameter measurements;

select a subset of the drill bit vibration measurements that are obtained from a shale formation from the formed relation and formation parameter measurements that indicate shale formation;

perform a linear regression on the selected subset of drill bit vibration measurements to determine a vibration shale baseline that indicates a linear increase for drill bit vibrations in shale formation with borehole depth;

predict a vibration measurement for the drill bit in shale formation at a new drill bit location using the vibration shale baseline and a depth of the new drill bit location;

compare a vibration measurement obtained at the new drill bit location to the predicted vibration measurement in shale formation at the new drill bit location to predict a formation type at the new drill bit location; and adjust a drilling operating parameter while drilling based on the predicted formation type.

2. The method of claim 1, further comprising determining the formation parameter at the drill bit using the drill bit vibration measurement obtained at the new drill bit location and the formed relation.

3. The method of claim 2, wherein determining the formation parameter at the drill bit further comprises performing at least one of: (i) selecting a single value of the formation parameter for a determined shale formation; and (ii) selecting a value of the formation parameter from the formed relation for a determined non-shale formation.

4. The method of claim 1, wherein the formation sensor is at a location uphole of the vibration sensor.

5. The method of claim 1, further comprising adjusting the formed relation for an effect of revolution rate of the drill bit on the vibration measurement.

6. The method of claim 1, further comprising updating the formed relation while drilling.

7. The method of claim 1, wherein the formation parameter is one of: (i) a gamma ray measurement; (ii) a neutron porosity measurement; (iii) a bulk density measurement; and (iv) a formation parameter having a correlation to a vibration measurement.

8. The method of claim 1, wherein the drill bit vibration is one of: (i) an axial vibration; (ii) a lateral vibration; and (iii) a torsional vibration.

9. The method of claim 1, wherein adjusting the drilling operating parameter further comprises controlling a thrust force on the drill bit based on the predicted formation type to control a rate of penetration.

10. A method of drilling a formation, comprising:

using a vibration sensor at the drill bit to obtain drill bit vibration measurements at a plurality of depths in a borehole and a formation sensor to obtain formation parameter measurements at the same plurality of depths;

using a processor to:

select a subset of the drill bit vibration measurements that are obtained from a shale formation from the formation parameter measurements that indicate shale formation;

determine a vibration shale baseline that indicates a linear increase for drill bit vibrations in shale formation with borehole depth by performing a linear regression on the selected subset of drill bit vibration measurements;

predict a vibration measurement for the drill bit in shale formation at a new drill bit location using the vibration shale baseline and a depth of the new drill bit location;

compare a vibration measurement obtained at the new drill bit location to the predicted vibration measurement in shale formation at the new drill bit location to predict a formation type at the new drill bit location; and adjust a drilling operating parameter while drilling based on the predicted formation type.

11. The method of claim 10, wherein selecting the subset of drill bit vibration measurements further comprises selecting drill bit vibration measurements for which the formation parameter indicates a shale formation.

12. The method of claim 10, further comprising determining the formation parameter at the drill bit from a comparison of the vibration measurement obtained at the new drill bit location and the predicted value obtained using the vibration shale baseline.

13. The method of claim 12, wherein the vibration shale baseline is determined from a linear regression using the selected drill bit vibration measurements.

14. The method of claim 10, further comprising adjusting the vibration shale baseline for an effect of revolution rate of the drill bit on the vibration measurements.

15. The method of claim 10, further comprising determining the vibration shale baseline while drilling.

16. The method of claim 10, wherein the formation parameter is one of: (i) a gamma ray measurement; (ii) a neutron porosity measurement; (iii) a bulk density measurement; and (iv) a formation parameter having a correlation to a vibration measurement.

17. The method of claim 10, wherein the vibration is selected from: (i) an axial vibration; (ii) a lateral vibration; and (iii) a torsional vibration.

18. A non-transitory computer-readable medium having instructions stored therein that when accessed by a processor enable the processor to perform a method, the method comprising:

receiving measurements of drill bit vibration obtained at a plurality of depths in the borehole using a vibration sensor at the drill bit;

receiving formation parameter measurements obtained at the plurality of depths in the borehole using a formation sensor;

using the formation parameter measurements to select a subset of the drill bit vibration measurements that are obtained from a shale formation;

determining a vibration shale baseline that indicates a linear increase for drill bit vibrations in shale formation with borehole depth from a linear regression of the selected subset of drill bit vibration measurements;

predicting a vibration measurement for the drill bit in shale formation at a new drill bit location using the vibration shale baseline and a depth of the new drill bit location;

comparing a vibration measurement obtained at the new drill bit location to the predicted vibration measurement in shale formation at the new drill bit location to predict a formation type at the new drill bit location; and controlling a drilling operating parameter while drilling to control drilling of the formation based on the determined formation type.

* * * * *